US008973791B2

(12) United States Patent
Collura et al.

(10) Patent No.: US 8,973,791 B2
(45) Date of Patent: Mar. 10, 2015

(54) FRAME FOR A DEVICE FOR HOLDING AND REPLACING CASTING PLATES AND ASSEMBLY

(75) Inventors: Mariano Collura, Bracquegnies (BE); Fabrice Sibiet, Colleret (FR)

(73) Assignee: Vesuvius Group S.A., Ghlin (BE)

( * ) Notice: Subject to any disclaimer, the term of this patent is extended or adjusted under 35 U.S.C. 154(b) by 259 days.

(21) Appl. No.: 13/636,044

(22) PCT Filed: Mar. 17, 2011

(86) PCT No.: PCT/EP2011/001324
§ 371 (c)(1),
(2), (4) Date: Sep. 19, 2012

(87) PCT Pub. No.: WO2011/113597
PCT Pub. Date: Sep. 22, 2011

(65) Prior Publication Data

US 2013/0008928 A1 Jan. 10, 2013

(30) Foreign Application Priority Data

Mar. 19, 2010 (EP) ..... 10157129

(51) Int. Cl.

| | |
|---|---|
| ***B22D 37/00*** | (2006.01) |
| ***B22D 41/24*** | (2006.01) |
| ***B22D 41/28*** | (2006.01) |
| ***B22D 41/34*** | (2006.01) |
| ***B22D 41/40*** | (2006.01) |
| ***B22D 41/56*** | (2006.01) |

(52) U.S. Cl.
CPC ..... *B22D 41/24* (2013.01); *B22D 41/28* (2013.01); *B22D 41/34* (2013.01); *B22D 41/40* (2013.01); *B22D 41/56* (2013.01)
USPC ..... 222/600; 266/236

(58) Field of Classification Search
CPC ..... B22D 41/22; B22D 41/24; B22D 41/34
USPC ..... 266/236; 222/600, 607
See application file for complete search history.

(56) References Cited

U.S. PATENT DOCUMENTS

| | | | | |
|---|---|---|---|---|
| 5,011,050 | A | 4/1991 | Verel | |
| 5,211,857 | A | 5/1993 | Brinker | |
| 6,019,258 | A | 2/2000 | Richard | |
| 2013/0008928 | A1 * | 1/2013 | Collura et al. | 222/607 |
| 2014/0203051 | A1 * | 7/2014 | Taburiaux | 222/600 |

FOREIGN PATENT DOCUMENTS

| | | | |
|---|---|---|---|
| EP | 0192019 | A1 | 8/1986 |
| WO | 2004/065041 | A1 | 1/2004 |

* cited by examiner

*Primary Examiner* — Scott Kastler
(74) *Attorney, Agent, or Firm* — Thomas Clinton; Donald M. Satina

(57) ABSTRACT

A frame, for a device for holding and replacing plates for transferring molten metal contained in a metallurgical vessel having a casting channel, defines a housing for receiving and holding a plate, when the device is assembled, in the operating position in the vicinity of the casting channel of the metallurgical vessel. The frame is arranged to enable the introduction of the plate into the housing, and the extraction of the plate from the housing, by translation along a plate insertion direction. The housing is formed so as to have an overall planar symmetry in relation to a central longitudinal plane parallel with the plate insertion direction. The frame comprises slots for receiving thrusters intended, when the device is assembled, to apply a force, in the direction of the metallurgical vessel, on a plate inserted in the housing.

10 Claims, 6 Drawing Sheets

FRAME FOR A DEVICE FOR HOLDING AND REPLACING CASTING PLATES AND ASSEMBLY

BACKGROUND OF THE INVENTION (a) Field of the Invention

The present invention relates to the technical field of the continuous casting of molten metal.

(b) Description of Related Art

A device for holding and replacing plates or tubes for transferring molten metal contained in a metallurgical vessel is already known in the art. The device can be arranged immediately below a metallurgical vessel and is used for transferring the molten metal from an upper metallurgical vessel to a lower metallurgical vessel for instance from a ladle to a tundish or from a tundish to a casting mould.

The plate generally consists of a metallic casing surrounding or cladding a refractory material. The plate is used to transfer the molten metal, either in the form of a free flow, or through a tube rigidly connected to the plate. In the latter case, the plate is frequently referred to as a "casting tube", "outer nozzle", submerged nozzle or pouring nozzle. Hereinafter, the term plate will be used to refer both to the plate for transferring molten metal in free flow form and to the plate provided with a tube referred to as a casting tube.

The devices for holding and replacing plates or tubes may have different names on the market such as tube changer device, device for the insertion and/or removal of a pouring nozzle, calibrated nozzle changer, tube exchange device or others.

A device for holding and replacing a plate for casting molten metal out of a vessel generally comprises a frame with a casting opening, said frame being configured for being fixed to the lower side of a metal casting vessel and comprising a first, upper portion and a second, lower portion, joining at a middle section plane defining the plane where an upper refractory element and a lower refractory element form a sliding contact,

- the upper side portion of the frame comprising n upper refractory element receiver, or means for receiving and clamping in place at its pouring position the upper refractory element, such that the through bore of the upper refractory element is in fluid communication with the casting opening and
- the lower side portion of the frame comprising:
- a passage extending along a first axis of first direction (X) between an inlet opening and an outlet opening configured for receiving and moving a plate from said inlet to said outlet, passing by a casting position in registry with the casting opening of the frame;
- a displacing element, or means for displacing, and a guide, or means for guiding, the plate from a standby position to a casting position in registry with the casting opening of the frame, and optionally for guiding it to the outlet, said guide or guiding means running substantially parallel to the first direction (X),
- substantially parallel to the first direction (X) and extending from the guide or guiding means at the level of the pouring nozzle casting position, means for pressing up the plate at its casting position in the direction of the upper portion of the frame (in the direction of the metallurgical vessel).

More specifically, the device generally consists of a frame comprising two guiding rails and rockers arms or thrusters for cooperation with a plate or a plate of a casting tube. The means for displacing the plate generally consist of a mechanical, pneumatic or hydraulic arm or cylinder.

The frame of the device for holding and replacing a plate is generally cast and is unlikely subjected to wear. However, the parts such as the clamping means, the guiding means and the thrusting means like the clamps, the rails, the rockers or the springs are wearing parts of the device. These parts are checked at each maintenance operation of the device and replaced if necessary.

The plate arranged below the vessel is worn in the course of metal casting, for example due to slag erosion. The casting orifice may also become clogged or obstructed over time. It is thus necessary to replace the plate during casting, using a device for holding and replacing the plate. Such devices are known particularly from the document EP 0 192 019 A1 relating to a device for replacing casting tubes and the document U.S. Pat. No. 6,019,258 relating to a device for replacing calibrated plates. The plate is replaced in the casting position by sliding a new plate which was in standby forwards, said new plate pushing the worn plate, so as to eject and replace said plate in the casting position. The devices generally comprise guiding means such as rails or slides and thrusting means or pushing means such as springs. The guiding and displacing means are used to guide and move the plate to the operating position thereof or remove the same from the operating position thereof. The thrusting or pushing means are used to hold the plate in tight contact with the refractory element located upstream when the plate is in the operating position.

Providing a sealing surface or shut-off surface or blank surface on the plate, arranged behind the plate casting orifice is known from the document WO 20041065041. This sealing surface is intended to seal the casting channel of the metallurgical vessel if required, for example in the event of an accident. Indeed, it may be necessary to stop (interrupt) the metal casting in the event of an emergency. For this purpose, it is simply necessary to push (move forward) the plate in the casting position by a distance greater than or equal to the casting channel diameter, so that the sealing surface blocks (closes) the channel.

In a device for holding and replacing a plate suitable to interrupt the cast in case of an emergency, the displacing means can adopt two successive positions:

- a casting position wherein the plate is in fluid communication with the casting channel
- a sealing position wherein the sealing surface of the plate is facing the casting channel Such devices generally require the use of a so-called double stroke jack or cylinder, the short stroke displacing the plate to the casting position and the long stroke displacing the plate to the sealing position. The sealing position is also called shut-off position or closure position.

By convention, the forward direction of a plate, frame or device for replacing plates is defined with reference to the direction of plate replacement in the device for replacing plates, the plate being moved forwards to adopt the following successive positions: standby position, casting position (when the casting orifice extends from the casting channel), sealing position (when the sealing surface seals the casting channel) and ejection (evacuation or exit) position (when the casting plate is released from the device).

One difficulty lies in that it is possible to arrange a new plate by mistake in the wrong direction in the device for holding and replacing plates. In this case, the sealing surface is not arranged behind but in front of the casting orifice. As a result, when the new plate is pushed to the casting position, the casting orifice thereof does not extend exactly from the casting channel and, furthermore, if the new plate is then pushed to the sealing position in the event of an emergency, the sealing surface is not opposite the casting channel, such that the casting is not completely discontinued. This may have serious consequences for the metal casting facility and for those working on the casting site, in that it is no longer possible to discontinue the casting.

FIG. 1 represents an example wherein a plate 10 according to the prior art has been inserted the wrong direction in a device 90 for holding and replacing plates. The device is used for transferring molten metal in a continuous casting facility, for example steel, for example from a tundish to a casting mould. The plate 10 replaces a worn plate 12, by sliding the plate 10 in the direction 14 corresponding to the first translation axis X, under the thrust of the displacing means, for example a hydraulic cylinder. In FIG. 1, the plate 10 is in a position which should have been a casting position if it had been inserted in the right direction.

The plate 10 comprises a sliding face 16, in contact with an upstream refractory element, with reference the direction of molten metal flow corresponding to the axis Z. More specifically, the face 16 is in contact with an inner nozzle 18 of the vessel, arranged in the bottom of the vessel, said inner nozzle 18 comprising a casting channel 20.

The sliding face 16 comprises a casting orifice 22, intended to extend from the channel 20 when the plate 10 is arranged in the right direction in the casting position, and a sealing (shut-off) surface 24, for sealing (closing) the channel 20 when the plate moves to the sealing (shut-off) position.

As can be seen in FIG. 1, when the plate 10 is in the casting position and in the wrong direction, only one gap 26 is generated between the casting channel 20 and the casting orifice 22. Therefore, although a maximum molten metal flow rate would be required, only the gap 26 allows the molten metal to pass through. Furthermore, if, for exceptional reasons, it is desired to discontinue casting, by pushing the plate 10 to the sealing position, the gap 26 widens and the casting channel 20 is not sealed by the sealing surface 24 allowing molten metal to pass through. This gap may even be the cause of leakage liable to allow the metal to infiltrate the device for replacing plates, and cause non-negligible damage in the casting facility.

The aim of the present invention is particularly that of improving the safety in the continuous casting facility in a simple manner.

The fact that an operator can arrange a plate in the wrong direction has been discussed in the documents U.S. Pat. No. 5,211,857 or U.S. Pat. No. 5,011,050. The devices described in these documents present two directions perpendicular to one another. One plate insertion direction or loading direction and one plate replacement direction or firing direction. The loading direction is perpendicular to the plate exchange direction. The plate exchange direction is parallel to the casting mould. The insertion of the plate into the device is made by sliding it onto the loading rails. The safety system comprises a pre-position guide defining a gauging opening therethrough complementary to the plate to require a single plate orientation to pass through said gauging opening as the plate is loaded into the device. In the loading area, the loading rails are asymmetrical or present a locating step which in cooperation with the pre-position guide prevent the plate from reaching the loading position if the plate orientation is not correct. In particular, the above documents describe a device having two different loading rails. For instance, one of the rails has a projection engaging with a groove arranged on the plate sliding surface. In the plate replacement direction, the two edges of the plate are identical and are devoid of asymmetry. This way, the core part of the device which operates the plate replacement is not modified internally and is substantially identical to the other known devices.

The devices describe in the documents U.S. Pat. No. 5,211,857 or U.S. Pat. No. 5,011,050 involve certain drawbacks. They require the use of a pre-position guide unit and the proper mounting of this last. The projection, the groove or the locating step have to be properly mounted on one of the loading rails. Furthermore, the projections and grooves have relatively small dimensions. It is thus possible that the operator would not realise that the plate has been arranged in the wrong direction. The rails are worn over time and the projections are also worn; it is possible that, after a certain period of use, the projection no longer fulfils the role thereof. The rails are also wearing parts requiring regular replacement. During the assembly or the maintenance of the device, the operator could easily make a mistake during the mounting of the loading rails and/or the pre-guide unit. For instance, he could position the left rail on the right or vice versa or forget to add the locating step.

BRIEF SUMMARY OF THE INVENTION

The present invention particularly relates to a device making it possible to avoid the abovementioned drawbacks. The operations of assembly and maintenance of the device being also foolproof for the operator.

To this end, the invention relates to a frame for a device for holding and replacing a plate for casting molten metal out of a vessel which renders the operation of maintenance and assembly foolproof for the operator.

The invention relates to a frame for a device for holding and replacing plates for casting molten metal out of a metallurgical vessel having a casting channel, the axis of the casting channel defining the casting axis (Z);

the frame comprising a casting opening arranged to be in registry with the casting channel of the vessel in operating position; the frame configured for being fixed to the lower side of a metallurgical vessel;

the frame comprising a first, upper portion and a second lower portion, joining at a middle section plane defining the plane where an upper refractory element and a plate form a sliding contact; the plane being substantially perpendicular to the casting axis (Z);

the upper portion of the frame comprising a receiver or means for receiving the upper refractory element when the device is assembled, in the operating position in the vicinity of the casting channel of the metallurgical vessel:

the lower portion of the frame comprising;

a passage extending between an inlet opening and an outlet along a first, translation axis (X) corresponding to the plate replacement direction, said passage being arranged to enable the introduction of the plate into the frame and the extraction of the plate from the frame by translation along the plate replacement direction; and wherein the translation axis (X) is parallel to the middle section plane and, together with the casting axis (Z) define a central longitudinal plane;

a housing (located in said passage between inlet and outlet openings, configured for receiving and holding a plate, when the device is assembled, in the operating position in the vicinity of the casting channel of the metallurgical vessel, said housing comprising a first and opposite second sides substantially parallel to and located on either sides of the central longitudinal plane, each of the first and second sides of the housing comprising recesses for receiving pressing elements or means for pressing up the plate, in the operating position, in the direction of the upper portion of the frame;

Characterised in that the orthogonal projection onto the central longitudinal plane of the recesses situated on the first side of the housing are spaced apart vertically from the orthogonal projection onto said central longitudinal plane of the recesses situated on the second side of the housing.

More specifically, the orthogonal projections onto the central longitudinal plane of the recesses respectively situated on either side of the housing are spaced apart vertically. In other words the recesses situated on either side of the housing are located at different levels or are offset. In certain embodiments, the orthogonal projections of each set of recesses could slightly overlap while still be offset.

The recesses are designed to match the pressing elements or means. The pressing elements or means are known to the person skilled in the art and usually consist of pushers including springs and rockers.

In certain embodiments, the recesses comprise one or any combination of any of the following features:

(a) holes for receiving compression means or compression elements, such as for receiving springs (b) grooves for mating pushers, such as for mating rocker arms, (c) slots having a slot axis for articulating the pushers In certain embodiments, the recesses are substantially identical on each side of the housing. This way, the same pressing element or pressing means parts can be used equivalently on either side of the housing.

Advantageously, the frame further comprises at least two fixing notches located at the inlet opening and situated on either side of the housing for attaching the rails for guiding the plates into the housing. Similarly, the orthogonal projections onto the central longitudinal plane of the fixing notches situated on either side of the housing are spaced apart vertically. The fixing notches are substantially identical. This way, the same rails can be used equivalently on either side of the housing.

The frame may also comprise at least two fixing notches (116,117) located at the outlet opening and situated on either side of the housing for attaching the rails (66, 68) for guiding the plates out of the housing. As for the fixing notches located at the inlet, the orthogonal projections onto the central longitudinal plane of the notches situated on either side of the housing are spaced apart vertically. The fixing notches being substantially identical, the same rails can be used indifferently on either side of the housing.

In certain embodiments, the fixing notches are located so as the rails attached to the fixing notches extend from the pushers received in the recesses situated on the same side of the housing. This way, the plate is displaced from the standby position to the operating position and from the operating position to the exit position along a substantially horizontal plane.

The invention provides a foolproof system ensuring that an inattentive operator would not assemble the parts of the device in the wrong direction, due to the fact that all the parts are identical. The asymmetry is created by the frame, the frame being designed for receiving standard identical parts in specific area.

As it is possible to fit the frame with the same pressing element or means and the same rails on either side of the housing, the stock management is also simplified.

The invention thus requires the use of a plate wherein the thrust edges, i.e. the portions to receive the thrust from the pressing element or means, are not symmetrical. Such a plate can thus only be inserted into the housing of the frame in one sole orientation ensuring the proper functioning thereof, both for metal casting and for interrupting said casting if required.

For matching the pushers of the device, the plate comprising a pair of opposed thrust edges spaced apart vertically.

In certain embodiments, the plate comprises a pair of opposed plate edges, one of which having a first thickness and the second of which having a second thickness greater than said first thickness; the bottom surface of the plate edges corresponding to the trust edges.

In certain embodiments, the second thickness is at least 5 mm greater then the first thickness, or at least 10 mm greater.

The term "plate edge thickness" refers to the distance, in the vertical direction, between the top surface and the bottom surface of the plate edge. Generally, the top surface of the edge is flush with the sliding face of the plate, and the bottom surface consists of a surface engaging by sliding with a bottom wall of a guiding rail provided on the device for holding and replacing plates. For example, both plate edges each have a substantially rectangular cross-section, the height of one of the two rectangles being smaller than that of the other.

In the case illustrated by the figures, the bottom surface of the plate edge corresponds to the sliding surface and the trust surface.

The invention also relates to an assembly of pressing element or means and of a frame wherein the pressing element or means are assembled into the recesses of each side of the housing.

The assembly further comprises a plate having a pair of opposed thrust edges mating the pressing element or means in operating position; typically a plate as described above. Due to the asymmetrical edges thereof, the plate can only be arranged in a device for replacing plates along a single direction, the asymmetrical edges performing a keying role. Indeed, since the two thrust edges do not match symmetrically, a simple way to distinguish them is provided and the insertion of one thrust edge instead of the other in the device for replacing plates can advantageously be prohibited. Also, if a new plate in the standby position is arranged in the wrong direction, the asymmetrical thrust edges indicate that the direction is incorrect. For example, the operator may observe that the arrangement is incorrect by noting that the sliding face of the plate in the standby position is not arranged correctly in a housing or that the casting tube is not perpendicular (vertical). According to a further example, the incorrectly positioned asymmetrical edges in relation to the device for replacing plates may prevent any insertion of the plate in the device. The asymmetrical edges may also prevent the insertion of a plate due to the interaction of the edges of the plate with the pushers of the frame.

Generally, the plate comprises a refractory element, the refractory element comprising a sliding face and a casting orifice, and a metallic casing cladding a portion of the refractory element but the sliding face. In certain embodiments, the metallic casing comprises the thrust edges.

The refractory element may comprise a casting tube opening onto the casting orifice and projecting from the metallic casing.

BRIEF DESCRIPTION OF THE SEVERAL VIEWS OF THE DRAWINGS

The invention will be understood more clearly on reading the following description, given merely as a non-limitative example of the scope of the invention with reference to the figures, wherein.

DETAILED DESCRIPTION OF THE INVENTION

The vertical direction is defined as the direction of flow of the molten metal at the metallurgical vessel outlet. Furthermore, the longitudinal direction of the casing, plate, frame or device for holding and replacing plates is defined as the direction wherein the plate is replaced from a standby position to a casting position. Finally, the transverse direction is defined as the direction perpendicular to the two other vertical and longitudinal directions, such that the longitudinal, transverse and vertical directions define a three dimensional orthogonal coordinate system. It should be noted that the longitudinal and transverse directions are defined with reference to the direction of movement of the plates during the replacement thereof in the device, these directions may particularly be applied to plates wherein the sliding face has a square or rectangular general shape, regardless of the orientation of the rectangle. The central longitudinal axis corresponds to the longitudinal axis of the sliding face of the plate or the casting opening of the frame. This longitudinal axis passes through the centre of the plate casting orifice, the orifice possibly having a circular or oblong shape, and through the centre of the sealing surface thereof, corresponding to the centre merging with the centre of the casting channel when the plate is in the sealing position.

Hereinafter, the vertical direction, corresponding to the casting direction, is referred to as the Z direction, the longitudinal direction, corresponding to the plate replacement direction, is referred to as the X direction, and the transverse direction is referred to as the Y direction. The X, Y, Z directions are orthogonal with respect to each other. In the case of the present invention, the plate replacement direction is also referred to as the plate insertion direction. The flow is carried out from the upper refractory element to the lower refractory element, in particular from the inner nozzle 18 to the plate 34.

In the case of a plate with a generally rectangular outline, the central longitudinal plane may be defined as the plane comprising the vertical axis passing through the centre of the casting orifice and the median of the two longest sides of the rectangle circumscribing the plate. The central longitudinal axis corresponds to the XZ plane in the operating position.

In the case of a plate with a generally square outline wherein the casting orifice is off-centre, the central longitudinal axis is the axis comprising the centre of the casting orifice and the intersection of the diagonals of the square circumscribing the plate. The longitudinal axis corresponds to the X axis when the plate is in the operating position.

Figure 10:
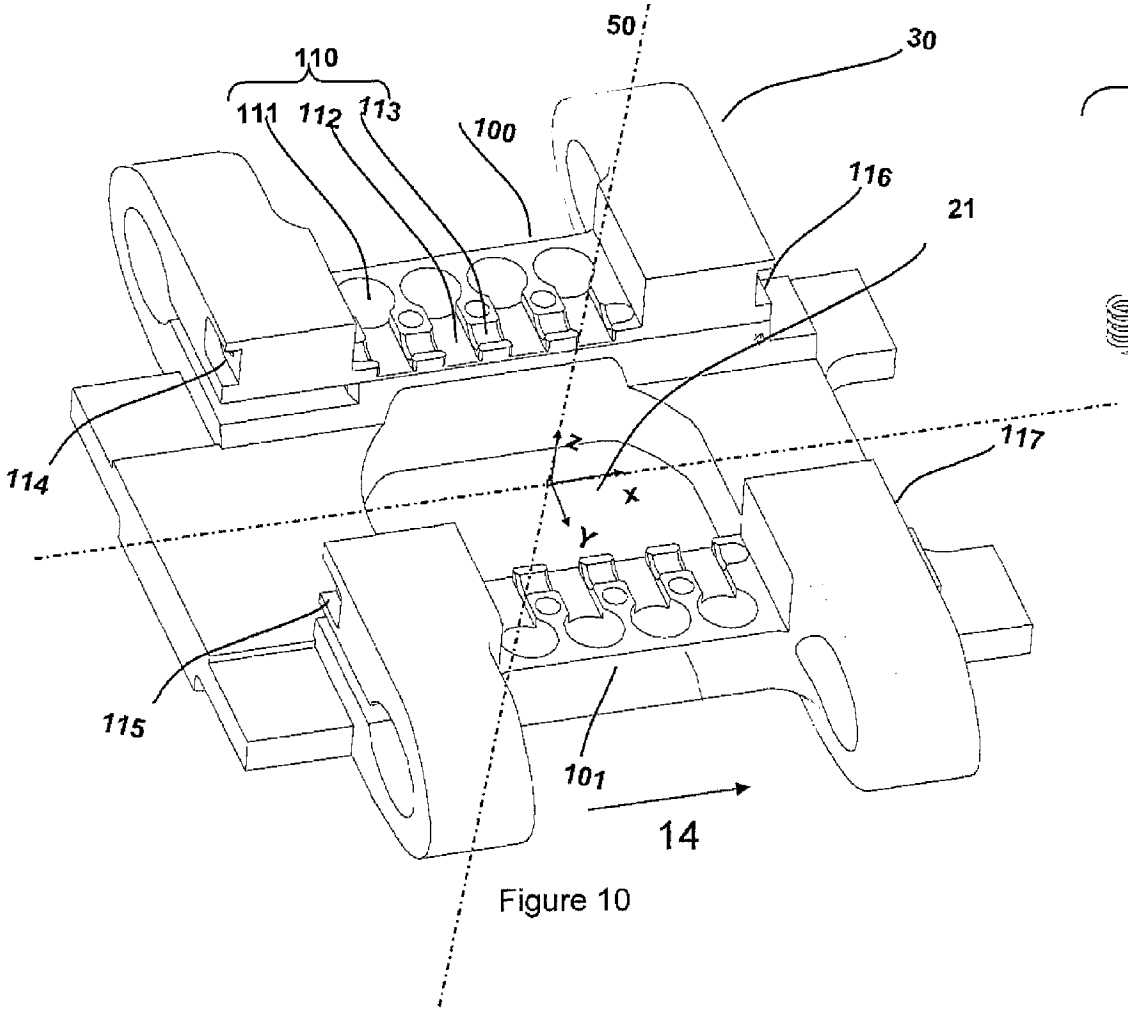
FIG. 10 is a perspective bottom view of a frame according to the invention.

As can be seen in FIG. 10, the frame 30 of the device 90 (not shown) comprises a casting opening 21 configured to be in registry with the casting channel of the vessel in operation. The three dimensional orthogonal coordinate system has been positioned in the centre of the casting opening 21 to facilitate the understanding of the invention. The translation axis X corresponds to the plate replacement direction also illustrated by the arrow 14. The axis Z corresponds to the casting direction and the axis Y corresponds to the transverse direction which is perpendicular to the other two axes.

The frame comprises a first upper portion and a second lower portion joining at a middle section plane 51 defining the plane where the inner nozzle 18 and the plate 34 form a sliding contact. The middle section plane 51 is represented FIG. 3. The upper portion of the frame is located above the plane 51 and the lower portion of the frame is located below plane 51. The sliding face of the inner nozzle 18 and the sliding face 16 of the plate 34 join at the middle section plane 51. The upper portion of the frame comprises receiving and clamping elements, or means for receiving and clamping the inner nozzle in operation position. The lower portion of the frame is described in relation to FIG. 10.

Figure 1:
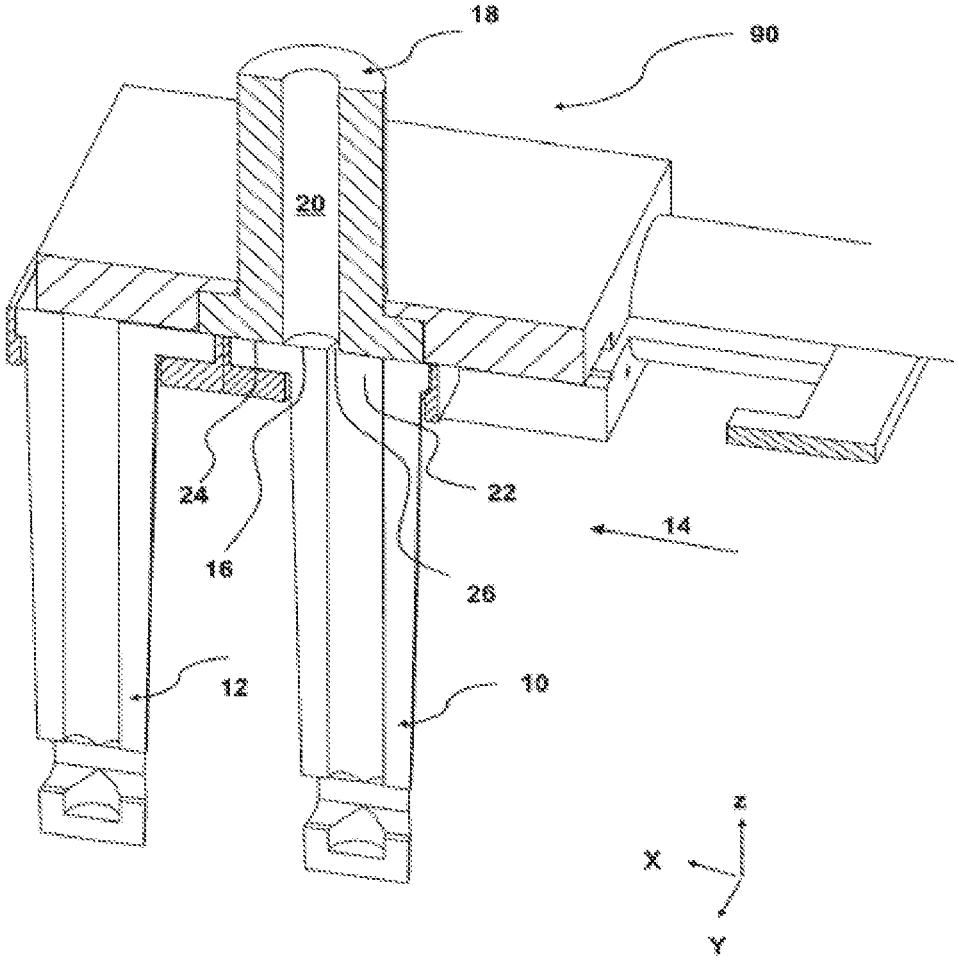
Figure 1 Prior Art
FIG. 1 is a longitudinal sectional view of a device for holding and replacing plates according to the prior art, illustrating the scenario wherein the plate is inserted in the wrong direction.
Figures 2, 3:
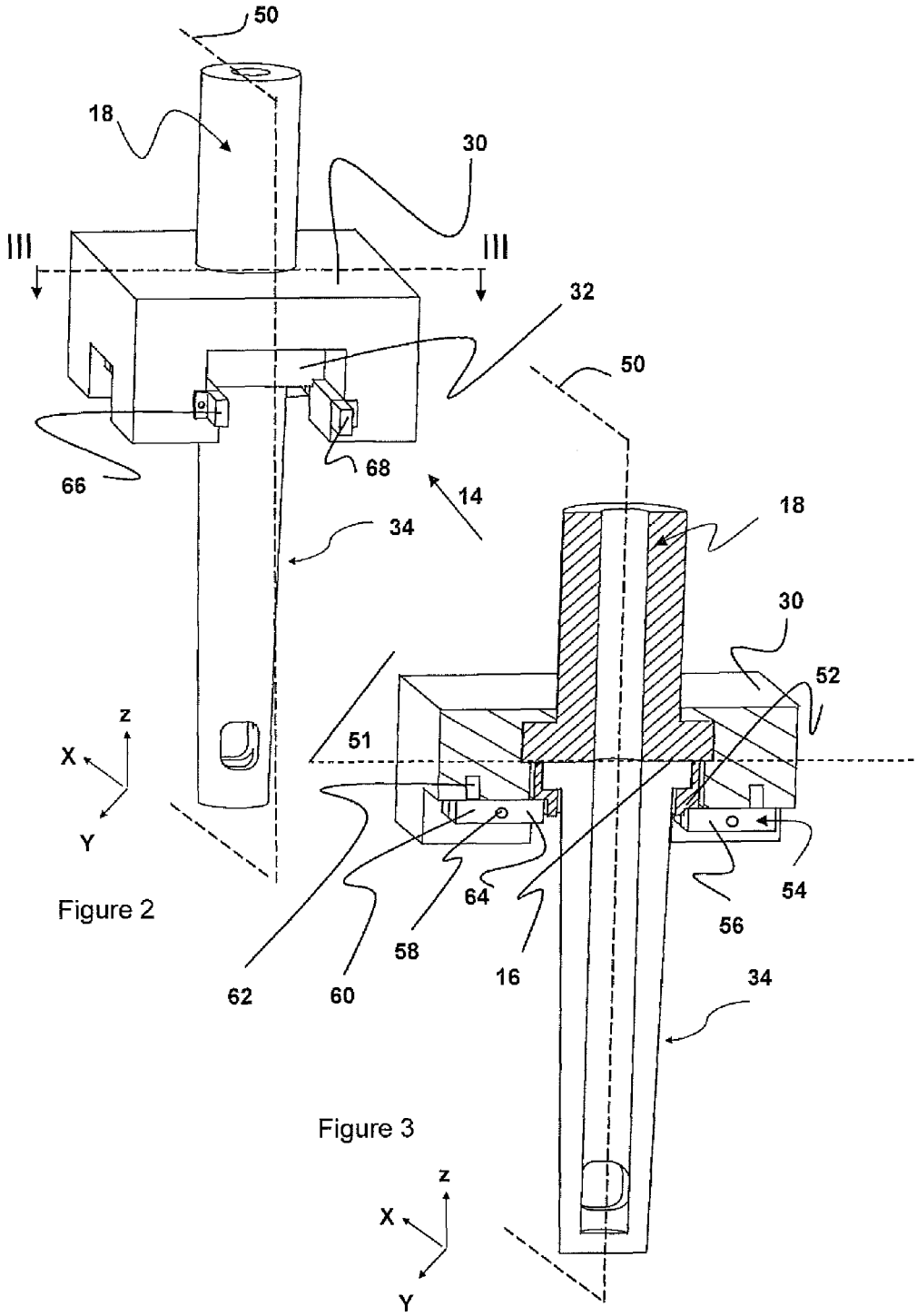
FIG. 2 is a perspective view of a frame of a device for holding and replacing plates, illustrating a plate in the casting position according to the invention.
FIG. 3 is a schematic cross-sectional view of FIG. 2 along the axis III-III.

The frame 30 represented in FIGS. 2 and 3 defines a housing 32 for receiving a plate 34 and holding it in the casting position against a metallurgical vessel (not shown) situated above said plate. The central longitudinal plane 50 of the frame is parallel with the XZ plane, or merges therewith.

Figure 11:
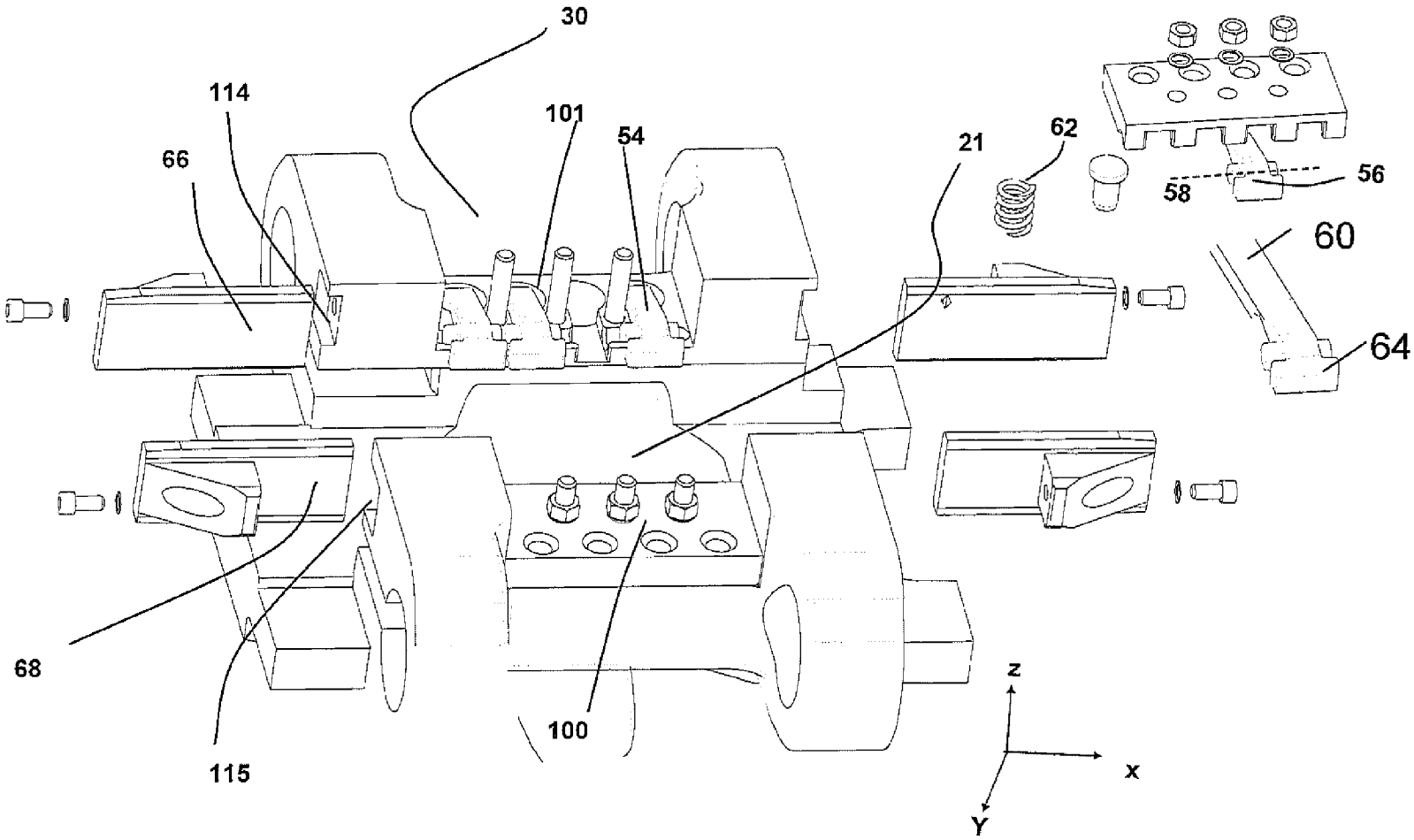
FIG. 11 is a perspective bottom view of a frame according to the invention partly assembled with the pressing means.

As can be seen in FIGS. 10 and 11 which is a bottom view of the lower part of the frame, the lower portion of the frame comprises a passage extending along the first translation axis (X) between an inlet opening and an outlet opening corresponding to the plate replacement direction 14. The plate 34 is introduced into the frame 30 at the inlet and is moved in operating position by translation along the plate replacement direction 14. When a new plate is introduced into the frame, the worn plate 34 is extracted from the frame 30 towards the outlet. The XZ plane corresponds to the central longitudinal plane 50 and the plane XY is parallel to the middle section plane 51. In operating position, the plate 34 is received and held in a housing 32 in the vicinity of the casting opening 21. The housing 32 comprises two sides 100,101 substantially parallel to the plate insertion direction 14, each side 100,101 of the housing 32 comprises recesses 110 for receiving means 120 for pressing up the plate, in the direction of the upper portion of the frame. The recesses of the side 100 are not at the same level as the recesses of the side 101. They are offset by a distance d along the Z axis.

Figure 9:
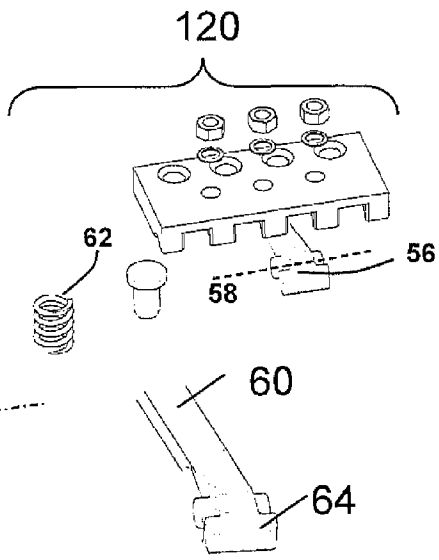
FIG. 9 illustrate the pressing means.

As explained above, on either side of the housing 32, in relation to the central longitudinal plane 50, the frame 30 comprises recesses for receiving pressing means 120 intended, when the device is assembled, to apply a force on the plate 34 in the direction of the upper portion of the frame. The pressing means 120 comprises pushers 54, for instance a rocker arm 56, traversed by a longitudinal axis 58, pivotably mounted about said axis 58. The arm 56 comprises an end or rocker arm extremity 60 for supporting a compression means 62, in this case, a compression spring 62. The springs 62 applying downward pressure on the end 60, which applies upward pressure parallel with Z on the opposite end 64. The pressing means are represented schematically in FIG. 3 and in detail in FIG. 9.

The recesses 110 comprise holes 111 and grooves 112 configured for receiving the springs 62 and the rocker arms 56 as well as slots 113 having a slot axis (58) for articulating the rockers (56)

The recesses for receiving the pressing means 120 on either side of the central longitudinal plane 50 are so disposed that the orthogonal projection onto the central longitudinal plane (50) of the recesses (110) situated on the first side (100) of the housing (32) are spaced apart vertically from the orthogonal projection onto said central longitudinal plane (50) of the recesses (110) situated on the second side (101) of the housing (32). Indeed, the pushers 54 are, in this case, positioned such that the height of the housing 32 next to the pushers on one side of the housing is different to the height of the housing 32 next to the pushers on the other side of the housing. The pushers 54 situated on either side of the housing 32 of the frame 30 are not at the same height along the Z axis. This creates asymmetry of the housing 32 along the central longitudinal plane 50, thus the plate insertion direction.

This asymmetry of the housing 32 makes it possible to produce a keying device ensuring that an inattentive operator would not introduce the plate 34 in the wrong direction into the housing 32, due to the fact that the recesses for the pressing element or means 120, in particular for the pushers, 54 situated on either side of the central longitudinal plane 50 of the housing 32 are not symmetrical.

As can be seen in FIGS. 10 and 11, the frame 30 also comprises notches 114,115 at the inlet opening for receiving a first 66 and a second 68 guiding rails. The notches are spaced apart vertically (along the axis Z). In fact, the notches are offset from a distance d. The rails are assembled into the notches by means known in the art. Once assembled, the first 66 and second 68 rails are asymmetrical in relation to the central longitudinal plane 50. They are also offset from a distance d. The distance d is illustrated FIG. 7.

The notches are positioned on the frame 30 so as the rails extend from the pushers 54 received in recesses situated on the same side of the housing 32. For the rails, the term "extending from" the thrusters refers to the fact that a plate 34 inserted in the device for holding and replacing plates can slide on the rails 66 and 68 into the housing 32 where it is then thrust towards the inner nozzle 18 by the pushers 54. The guiding rails 66 and 68 can thus be slightly offset in relation to the pushers 54.

The frame 30 may also comprise similar rails 116,117 situated at the outlet opening (FIG. 10). These rails are used to guide the worn plate in the ejection or exit position. As for the rails 66 and 68, these rails extend from the pushers 54 received in recesses situated on the same side of the housing 32.

In the case illustrated, the rails 66 and 68 are identical and standard but are positioned on the frame at different heights along the Z axis. During assembly of the frame 30 or during maintenance operations, an inattentive operator would not be able to assemble the rails incorrectly as all the rails are identical and fit the notches. The rails 66, 68, in this embodiment, are attached to the frame 30 by known means, for example screws (FIG. 11).

FIG. 11 represents a frame partly assembled with the pressing element or means and the rails. As can be seen in FIG. 11, the pressing element or means and the rails are identical for both sides of the frame. The asymmetry is given by the location of the recesses and the location of the notches.

Figure 4:
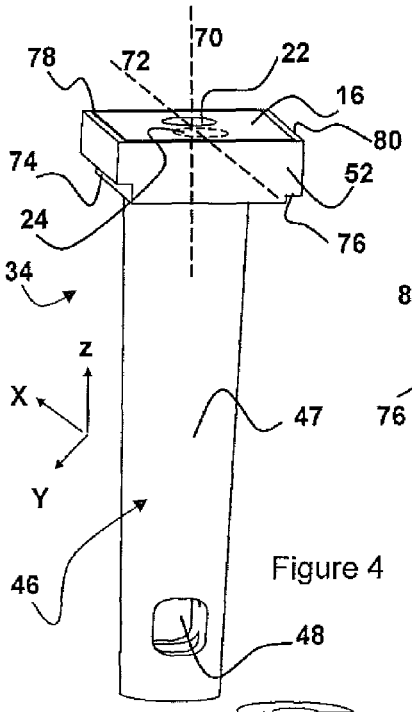
FIG. 4 is a perspective view of a plate of an assembly according to the invention.

It can be seen in FIG. 4 that the plate 34 according to the invention comprises a refractory element 46 and a metallic casing 52 for encasing the refractory 46. The refractory element 46 comprises a casting tube 47, extending from the casting channel 20 to lateral outlets or ports 48 through which the molten metal flows. The casting tube projects downstream from the metallic casing 52, with reference to the direction of flow of the molten metal. However, it could be envisaged that the element 46 with the casing 52, form a basic plate, without or with a short tubular extension 47.

The plate 34, more specifically the refractory element 46, comprises a sliding face 16. In the casting position, the sliding face 16 is in contact with an upstream refractory element, with reference to the direction of flow of the molten metal. More specifically, the face 16 is in contact with an inner nozzle 18 partly embedded into the bottom wall of a metallurgical vessel, said inner nozzle 18 comprising a casting channel 20.

The sliding face 16 comprises a casting orifice 22 centred on a geometric axis 70 and intended to extend from the channel 20 when the plate 34 is in the casting position. Furthermore, the sliding face 16 comprises, to the rear of the orifice 22, a sealing surface or shut-off surface 24 for sealing the channel 20 when the plate 34 moves to the sealing position. The orifice 22 is aligned with the sealing surface 24, along a longitudinal axis 72 which, with the geometric axis 70 of the casting orifice 22, defines a central plane (70,72). The central plane corresponds to the central longitudinal plane 50 of the housing 32 when the plate 34 is inserted in the device.

This plate 34 comprises, on either side of the casting orifice in relation to the central plane, thrust edges 74, 76, intended to be subjected to a force applied by the pushers 54 when the plate 34 is inserted into the device. The thrust edges 74, 76, do not match in the planar symmetry defined by the central plane. In the case illustrated, the plate sliding edges enabling the plate to slide in the device for holding and replacing plates merge with the thrust edges 74, 76.

These thrust edges 74, 76 are thus asymmetrical in relation to the central plane or the central longitudinal plane 50 such that a single direction is possible for introducing the plate 34 into the device for replacing plates. More specifically, in this example, the plate edges 78, 80 are asymmetrical along the vertical direction Z, in that they have a different thickness, along the entire guiding length thereof. Indeed, each edge 78, 80, comprises three adjacent surfaces respectively orthogonal to one another, i.e. a horizontal top surface 78*a*, 80*a*, slightly recessed with respect to the sliding face 16 of the refractory element 46, a substantially vertical lateral surface 78*b*, 80*b*, parallel to the central plane and a horizontal bottom surface 78*c*, 80*c*, in this case merged with the thrust edges 74, 76. The thickness 84, or height 84, of the first edge 80 is greater than the thickness 82 of the second edge 78. In other words, the distance in the Z direction of the orthogonal projection of the edge 82 on the central plane is less than that of the edge 80, by a value d. For improved comprehension, the references have been indicated in FIG. 5.

It can be seen in FIG. 4 that the lateral outlets 48 are aligned along the longitudinal axis 72 substantially parallel with the thrust and sliding edges 74, 76 of the plate 34.

Figure 5:
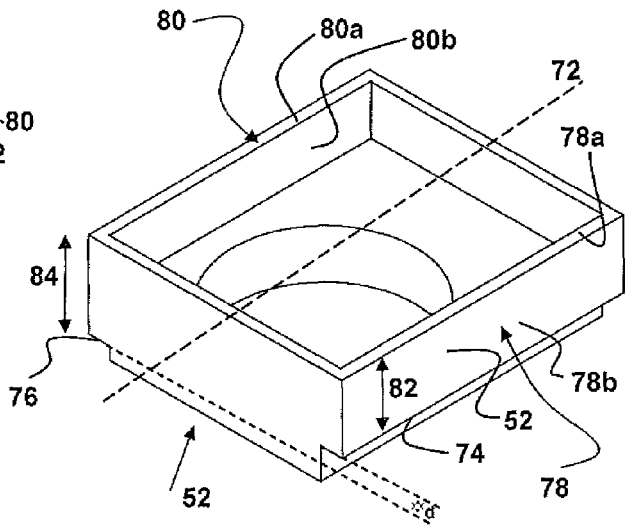
FIG. 5 is a perspective view of a metallic casing of a plate according to FIG. 4.

The metallic casing 52 illustrated in FIG. 5 is made of cast iron and is thick but it could be made of another material. It is intended to clad the plate portion of the refractory element 46, seen in FIG. 4. The assembly of the casing 52 and the element 46 forms a plate 34 for transferring the liquid metal. The casing 52 is particularly used to stiffen the element 46.

The casing 52 is much more resistant than the refractory element 46 to the molten metal casting conditions. Therefore, it can be considered to reuse the casing for assembling a new refractory element 46 into it. As mentioned above, the refractory element projects from the metallic casing. The surfaces 78*a* and 80*a* are thus slightly recessed in relation to the sliding surface 16.

Figure 6:
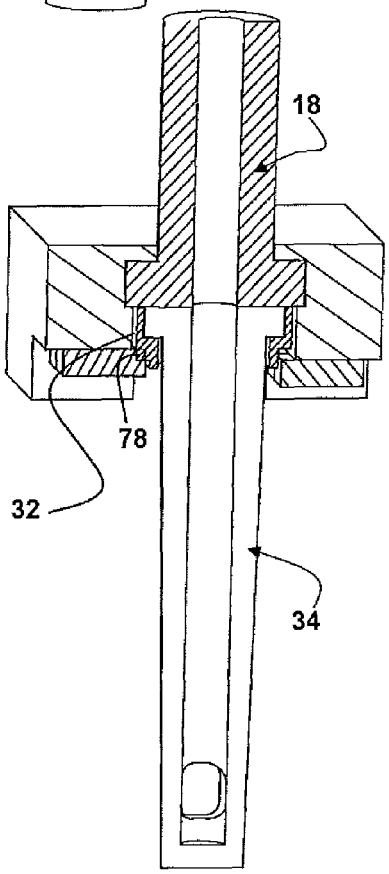
FIGS. 6 and 7 are similar views to FIGS. 2 and 3 representing impossible insertions of a plate in a frame according to the invention.
Figure 7:
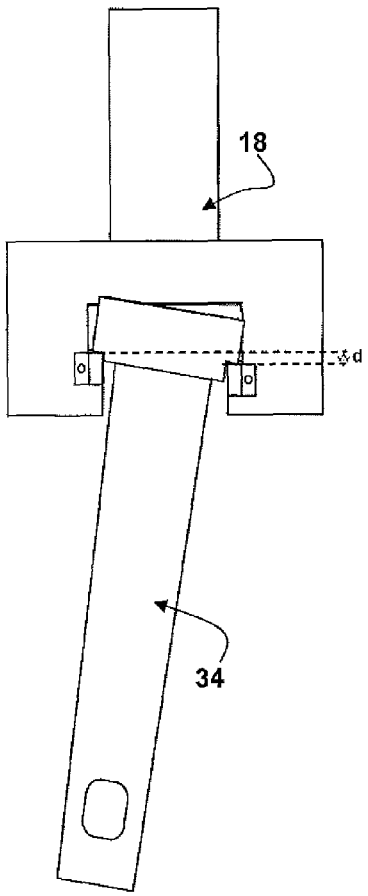

Due to the asymmetry of the edges 78, 80 of the plate 34 and the asymmetry of the pushers 54 and the rails 66, 68, it is not possible to insert the plate 34 in the wrong direction in a device for replacing and holding plates, as illustrated in FIGS. 6 and 7 where it can be seen that if an operator tries to insert the plate 34 in the wrong direction, i.e. by positioning the sealing surface 24 at the front, the edge 78 would not be able to enter the housing 32 as the thickness 84 thereof is greater than the height of the housing 32 at this point. Furthermore, if the frame 30 comprises guiding rails 66, 68, to the rear of the housing 32, the operator may be able to slide the plate 34 on these rails, but he will quickly notice the error as the axis of the casting tube would not be aligned with the casting direction Z and the plate 34 would not be able to enter the housing 32.

In the example shown FIG. 3, the asymmetry is provided on the metallic casing. The casing 52 has a pair of opposed side edges of different thickness. but the refractory element 46 is of the standard type, i.e. having no asymmetry in relation to the central plane. However, it is also possible to use a refractory 46 itself asymmetrical in relation to the central plane.

Figure 8:
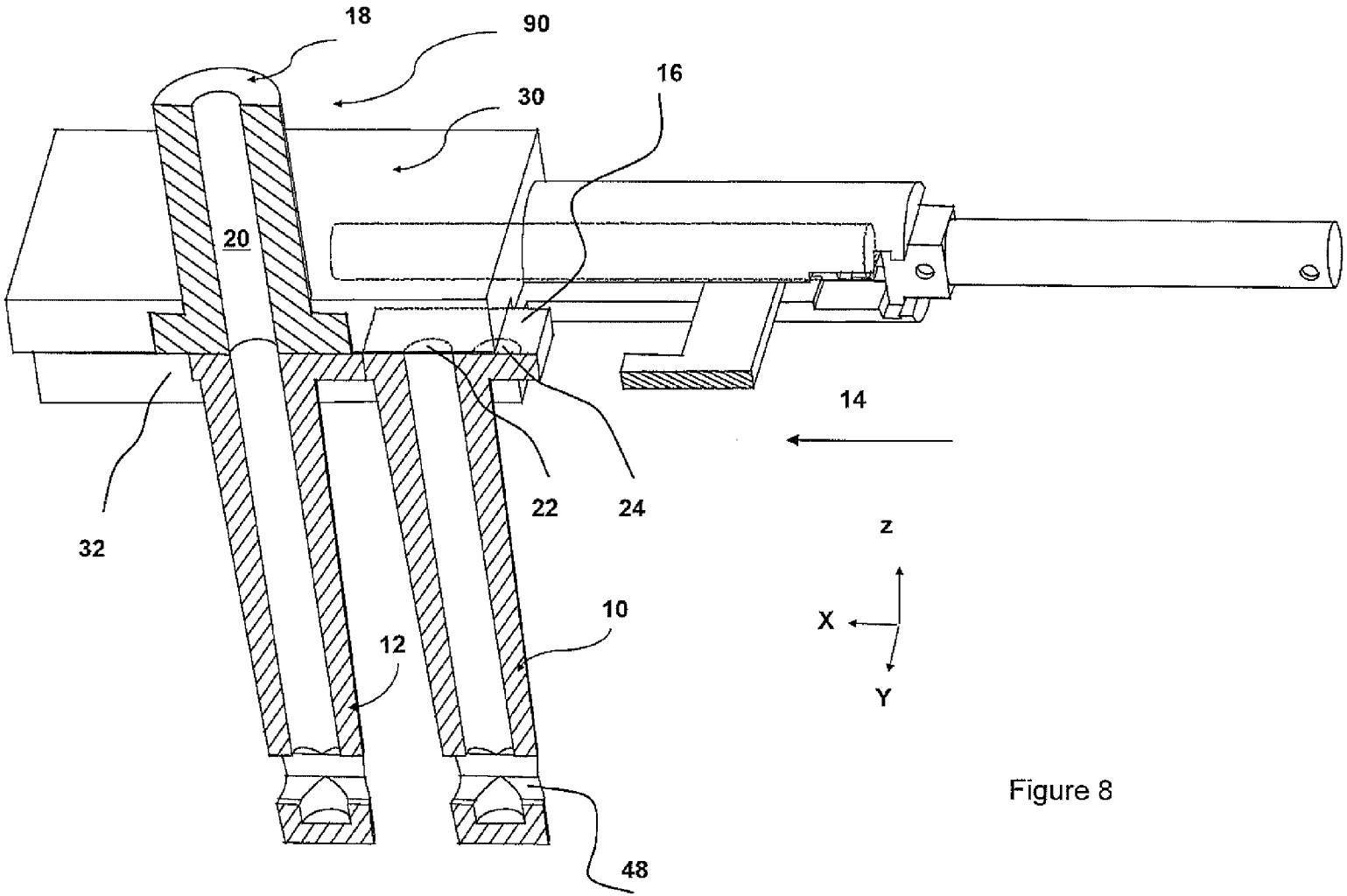
FIG. 8 is a longitudinal sectional view of a device for holding and replacing plates, illustrating a plate in the casting position and a plate in the standby position.

The operation of the device 90 will now be described with reference to FIG. 8.

When a plate 12 is in the casting position, a new plate 10 is moved to the standby position on the device 90. To replace the plate 12, the plate 10 is pushed in the X direction, which moves the plate 12. The plate 12 first moves to the sealing position and, then, under the effect of an additional driving force, moves to its exit position. Once the plate 10 has replaced the plate 12 in casting position, a new plate can be fed again in standby position It is understood that, due to the asymmetry of the thrust edges 74, 76 of the plate 34 and the asymmetry of the frame 30 (leading to the asymmetry of the pressing element or means 120 and of the guiding element or means (66, 68)), the plate 10 is guaranteed to be inserted in the correct direction in the device 90.

It should be noted that the invention is not limited to the embodiments described above.

REFERENCES

10. New plate
12 Worn plate
14 Sliding direction
16 Sliding face
18 Inner nozzle
20 Casting channel
21 Casting opening
22 Casting orifice
24 Sealing surface or shut-off surface
26 Gap
30 Frame
32 Housing
34 Plate
46 Refractory element
47 casting tube of the Refractory element
48 outlets or ports
50 central longitudinal plane
51 middle section plane
52 Metallic casing
54 Thrusters or pushers
56 Arm or Rocker arm
58 slot axis
60, 64 arm extremity
62 Compression means
66,68 Rails for guiding the plate
70 Geometric axis (=axis of the casting orifice)
72 Longitudinal axis
74, 76 Thrust edge
78, 80 Plate edge
78*a*, 80*a* Top surface of edge
78*b*, 80*b* Lateral surface of edge
78*c*, 80*c* Bottom surface of edge
82, 84 Edge thickness
90 Device
100,101 Side of housing
110 Recesses
111 Hole
112 Groove
113 Slot
114,115, 116,117 Notch
120 Pressing means

We claim:

1. Frame for a device for holding and replacing plates for casting molten metal out of a metallurgical vessel having a casting channel, the axis of the casting channel defining the casting axis (Z);

the frame comprising a casting opening arranged to be in registry with the casting channel of the vessel in operating position; the frame configured to be fixed to the lower side of a metallurgical vessel;

the frame comprising a first, upper portion and a second lower portion, joining at a middle section plane defining the plane where an upper refractory element and a plate form a sliding contact; the plane being substantially perpendicular to the casting axis (Z);

the upper portion of the frame comprising an upper refractory element receiver when the device is assembled, in the operating position in the vicinity of the casting channel of the metallurgical vessel:

the lower portion of the frame comprising;

a passage extending between an inlet opening and an outlet along a first, translation axis (X) corresponding to a plate replacement direction, said passage being arranged to enable the introduction of the plate into the frame and the extraction of the plate from the frame by translation along the plate replacement direction; and wherein the translation axis (X) is parallel to the middle section plane and, together with the casting axis (Z) defines a central longitudinal plane;

a housing located in said passage between inlet and outlet openings, for receiving and holding a plate, when the device is assembled, in the operating position in the vicinity of the casting channel of the metallurgical vessel, said housing comprising a first and opposite second sides substantially parallel to and located on either sides of the central longitudinal plane, each of the first and second sides of the housing comprising recesses for receiving a pressing element for pressing up the plate, in the operating position, in the direction of the upper portion of the frame;

wherein the orthogonal projection onto the central longitudinal plane of the recesses situated on the first side of the housing are spaced apart vertically from the orthogonal projection onto said central longitudinal plane of the recesses situated on the second side of the housing.

2. Frame according to claim 1, wherein the orthogonal projections onto the central longitudinal plane of the recesses respectively situated on either side of the housing overlap.

3. Frame according to claim 1, wherein said recesses comprise a feature selected from the group consisting of:

(a) holes configured to receive compression elements;

(b) grooves configured to receive mating pushers; and (c) slots having a slot axis configured to receive articulating mating pushers.

4. Frame according to claim 1, comprising at least two fixing notches located at the inlet opening and situated on either side of the central longitudinal plane, the at least two fixing notches being configured to attach rails for guiding the plates, wherein the orthogonal projections onto the central longitudinal plane of the at least two notches are spaced apart vertically.

5. Frame according to claim 1, comprising at least two fixing notches located at the outlet opening and situated on either side of the central longitudinal plane, the at least two fixing notches being configured to attach rails for guiding the plates, wherein the orthogonal projections onto the central longitudinal plane of the at least two notches are spaced apart vertically.

6. Frame according to claim 4, wherein the fixing notches are located so that the attached rails extend parallel to the translation axis (X) from the pushers received in the recesses situated on the same side of the housing.

7. Assembly of pressing element and of a frame according to claim 1 wherein the pressing element is assembled into the recesses of both first and second sides of the housing.

8. Assembly according to claim 7, further comprising a plate, the plate comprising a pair of opposed thrust edges mating the pressing element in operating position.

9. Assembly according to claim 7 wherein the plate comprises a pair of opposed first and second plate edges, the first plate edge having a first thickness and the second plate edge having a second thickness greater than said first thickness; the bottom surface of said first and second plate edges corresponding to the thrust edges.

10. Assembly according to claim 9 wherein the second thickness is at least 5 mm greater than the first thickness.

* * * * *